US010603573B1

(12) United States Patent
Kang et al.

(10) Patent No.: US 10,603,573 B1
(45) Date of Patent: Mar. 31, 2020

(54) TICKET OUTPUTTING GAME MACHINE

(71) Applicant: KOMUSE Co., Ltd., Paju-si, Gyeonggi-do (KR)

(72) Inventors: Nam Ho Kang, Gimpo-si (KR); Gyo In Lim, Goyang-si (KR)

(73) Assignee: KOMUSE CO., LTD., Paju-si (KR)

( * ) Notice: Subject to any disclaimer, the term of this patent is extended or adjusted under 35 U.S.C. 154(b) by 0 days.

(21) Appl. No.: 16/394,600

(22) Filed: Apr. 25, 2019

(30) Foreign Application Priority Data

Jan. 29, 2019 (KR) ..... 10-2019-0011069

(51) Int. Cl.

| | |
|---|---|
| ***A63F 7/02*** | (2006.01) |
| ***A63F 7/30*** | (2006.01) |
| *G07F 17/32* | (2006.01) |
| *A63F 7/34* | (2006.01) |
| *A63F 7/24* | (2006.01) |
| *G07F 17/36* | (2006.01) |
| *G07F 17/42* | (2006.01) |

(52) U.S. Cl.
CPC ..... *A63F 7/025* (2013.01); *A63F 7/307* (2013.01); *A63F 7/02* (2013.01); *A63F 7/2409* (2013.01); *A63F 7/2481* (2013.01); *A63F 2007/303* (2013.01); *A63F 2007/345* (2013.01); *A63F 2250/146* (2013.01); *G07F 17/3295* (2013.01); *G07F 17/3297* (2013.01); *G07F 17/36* (2013.01); *G07F 17/42* (2013.01)

(58) Field of Classification Search
CPC ..... A63F 7/02; A63F 7/2481; A63F 7/2409; A63F 2007/345; A63F 2007/303; A63F 2250/146; G07F 17/3295; G07F 17/3297; G07F 17/42; G07F 17/36
USPC ..... 273/129 T, 129 V, 129 W, 440, 442, 273/119 R, 122 R; 463/7, 64, 67
See application file for complete search history.

(56) References Cited

U.S. PATENT DOCUMENTS

| | | | | |
|---|---|---|---|---|
| 2,090,613 A * | 8/1937 | Breitenstein | ..... | A63D 13/00 273/121 E |
| 4,053,158 A * | 10/1977 | Breslow | ..... | A63F 7/048 273/120 R |
| 6,227,967 B1 * | 5/2001 | Peretz | ..... | G07F 17/3213 273/118 A |

FOREIGN PATENT DOCUMENTS

| | | | | |
|---|---|---|---|---|
| GB | 325089 A * | 2/1930 | ..... | G07F 17/30 |
| GB | 418912 A * | 11/1934 | ..... | A63D 13/00 |
| KR | 10-0902069 B1 | 6/2009 | | |

* cited by examiner

*Primary Examiner* — Benjamin Layno
(74) *Attorney, Agent, or Firm* — Polsinelli PC

(57) ABSTRACT

Disclosed is a ticket outputting game machine. The ticket outputting game machine includes a body having guide rails formed on a top surface thereof, a hitting portion formed on a front end of the guide rails, and a handle controlling a hitting force of the hitting portion on a front surface thereof, ticket display devices installed in a zigzag structure on both sides of the guide rails, and a ball position determination portion determining a held position of a ball between the guide rails to hit the ball by the hitting portion such that the ball moves along the guide rails and is held at a position determined by the ball position determination portion and the number of tickets displayed on the ticket display device corresponding to the position of holding the ball are output.

8 Claims, 5 Drawing Sheets

TICKET OUTPUTTING GAME MACHINE

CROSS-REFERENCE TO RELATED APPLICATION

This application claims priority to and the benefit of Korean Patent Application No. 10-2019-0011069, filed on Jan. 29, 2019, the disclosure of which is incorporated herein by reference in its entirety.

BACKGROUND

1. Field of the Invention

The present invention relates to a game machine, and more particularly, to a ticket outputting game machine in which a ball is moved along guide rails in order to be held by a ball position determination portion at a position corresponding to a ticket display device so as to obtain the number of tickets displayed on the ticket display device at which the ball is located.

2. Discussion of Related Art

Generally, a game vending machine is an apparatus allowing a designated free gift to be given according to a result of a game and includes a free gift issuing machine in order for a user to feel a sense of accomplishment.

Here, in the case of such a game vending machine, a result of a game is determined according to a manipulatory ability of a user so that the user, who enjoys playing the game, feels a sense of achievement while obtaining a free gift.

Patent document 1 discloses a conventional ball game machine. Referring to this document, the machine includes a body, guide rails formed on a top surface of the body to be bent to be continuously curved, a damper spring installed between the guide rails and the top surface of the body to hold up and support the guide rails, a sensor portion installed on a periphery of the top surface of the body and the guide rails and sensing a ball moving along the guide rails, and a display panel installed on a front end of the body and configured to receive a sensing portion signal and display a score.

Here, a transparent cover, which covers the guide rails, is installed on the top surface of the body, and long holes, which allow the ball mounted on the guide rails to be gripped, are formed on both sides of the transparent cover.

Also, a bar, which rotates toward the guide rails and pushes the ball located at an end of the guide rails toward the guide rails, is formed on a front end of the top surface of the body.

That is, when an external surface of the ball is gripped through the long hole of the transparent cover and the ball is pushed toward the guide rails to move along the guide rails while being gripped, the ball moves along the guide rails having a continuously bent wave shape and is mounted on a determined position on the guide rails.

Here, a bent portion of the guide rails, which is recessed, is supported by the damper spring so as to prevent the bent portion, which is recessed by a weight of the ball, from drooping.

Also, while the ball moves along the guide rails, each of first, second, and third sensors corresponding to ball movement positions senses the ball and transmits a signal thereof to the display panel such that a score, which varies according to an arrival position of the ball moving along the guide rails, is displayed on the display panel.

However, the above-described patent document 1 has problems that since a result value of a game varies according to a difference in the physique of a player, it is difficult to play a game, players who play the game cannot play the game under the same conditions, damage to a hand gripping a ball occurs due to an action of excessively pushing the ball within a length of a long hole, children, the old and the infirm, or women, who have relatively less muscular strength, have difficulties in playing the game, and the ball moving along the guide rails collides with the display panel such that reliability of products is degraded.

RELATED ART DOCUMENTS

Patent Document (Patent Document 1) KR10-0902069 B1

SUMMARY OF THE INVENTION

The present invention is directed to providing a ticket outputting game machine in which guide rails are formed on a top surface, a hitting portion is formed on a front end of the guide rails, a body having a handle controlling a hitting force of the hitting portion on a front surface thereof is included, ticket display panels having a zigzag structure are installed on both sides of the guide rails, and a ball position determination portion determining a held position of a ball is formed between the guide rails such that the ball moves along the guide rails and is held at a position determined by the ball position determination portion and the number of tickets displayed on the ticket display device corresponding to the position of holding the ball are outputted.

According to an aspect of the present invention, there is provided a ticket outputting game machine including a body which includes a pair of guide rails formed on a top surface along a longitudinal direction, a hitting portion formed at a front end of the guide rails to hit a ball to allow the ball to move along the guide rails, and a handle formed on a front surface and connected to the hitting portion to control a hitting force of the hitting portion, a plurality of ticket display devices installed in a zigzag structure along a longitudinal direction of both sides of the guide rails to display a ticket output amount, and a ball position determination portion installed between the guide rails of the body and passing the ball moving along the guide rails to allow the ball moving toward a front end of the body to be held such that the ball is located at a position corresponding to any one of the plurality of ticket display devices.

The hitting portion of the body may be pulled by the handle to move backward but return to an original position due to an elastic force and hit the ball.

The hitting portion may include a rotating bar, which is rotated by a determined angle on the basis of one end, and a hitting roller, which is rotatably installed on a top end of the rotating bar and rubs an external surface of the ball while hitting the ball.

The ticket display device may include a bonus ticket display portion installed at a rear end of the body and configured to display a bonus ticket number, a plurality of fixed ticket display portions installed along a longitudinal direction of both the guide rails and configured to display a set output ticket number, and an interconnected ticket display portion installed between the fixed ticket display portions and configured to receive a signal of the bonus ticket display portion and display a bonus output ticket number.

The ball position determination portion may include a holding plate, which is installed between the guide rails to divide the plurality of ticket display devices, while both ends thereof are rotatably installed on both ends of the guide rails to rotate in position, and includes a rotational bracket protruding downward from a bottom end, a movement portion, which is installed below the holding plate to be horizontally movable and includes a sensor formed on a top surface thereof and sensing a rotational bracket rotated by the holding plate, and a driving portion, which is installed below the movement portion and horizontally moves the movement portion to allow the sensor to be located within a radius of the rotational bracket or to deviate from the radius of the rotational bracket so as to adjust a position of the movement portion.

The ball position determination portion may include, among the plurality of holding plates, a holding plate, which has a relatively long length and is formed at a front end between the guide rails corresponding to the interconnected ticket display portion of the ticket display device, and, among the holding plates, a holding plate, which has a relatively short length and is formed at a rear end between the guide rails corresponding to the interconnected ticket display portion of the ticket display device.

The movement portion may further include a buffer portion formed at a top surface of one side of the sensor and configured to restrict a rotation angle of the rotational bracket of the holding plate.

The movement portion may include a rack gear on a bottom surface thereof, and the driving portion may further include a pinion gear on one side thereof which engages with the rack gear and is rotatably driven to horizontally move the rack gear.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
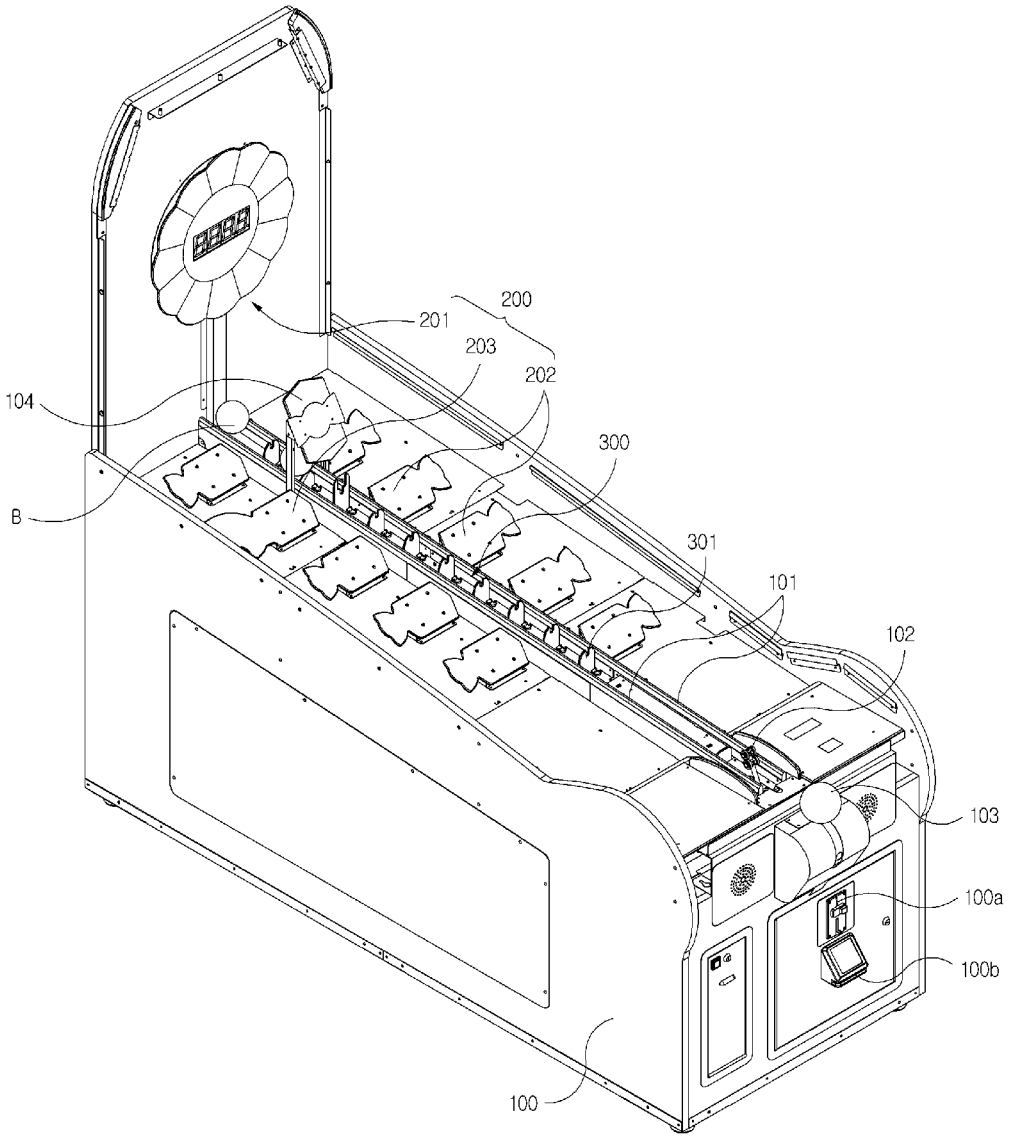
FIG. 1 is a perspective view of a ticket outputting game machine according to an embodiment of the present invention.
Figure 2:
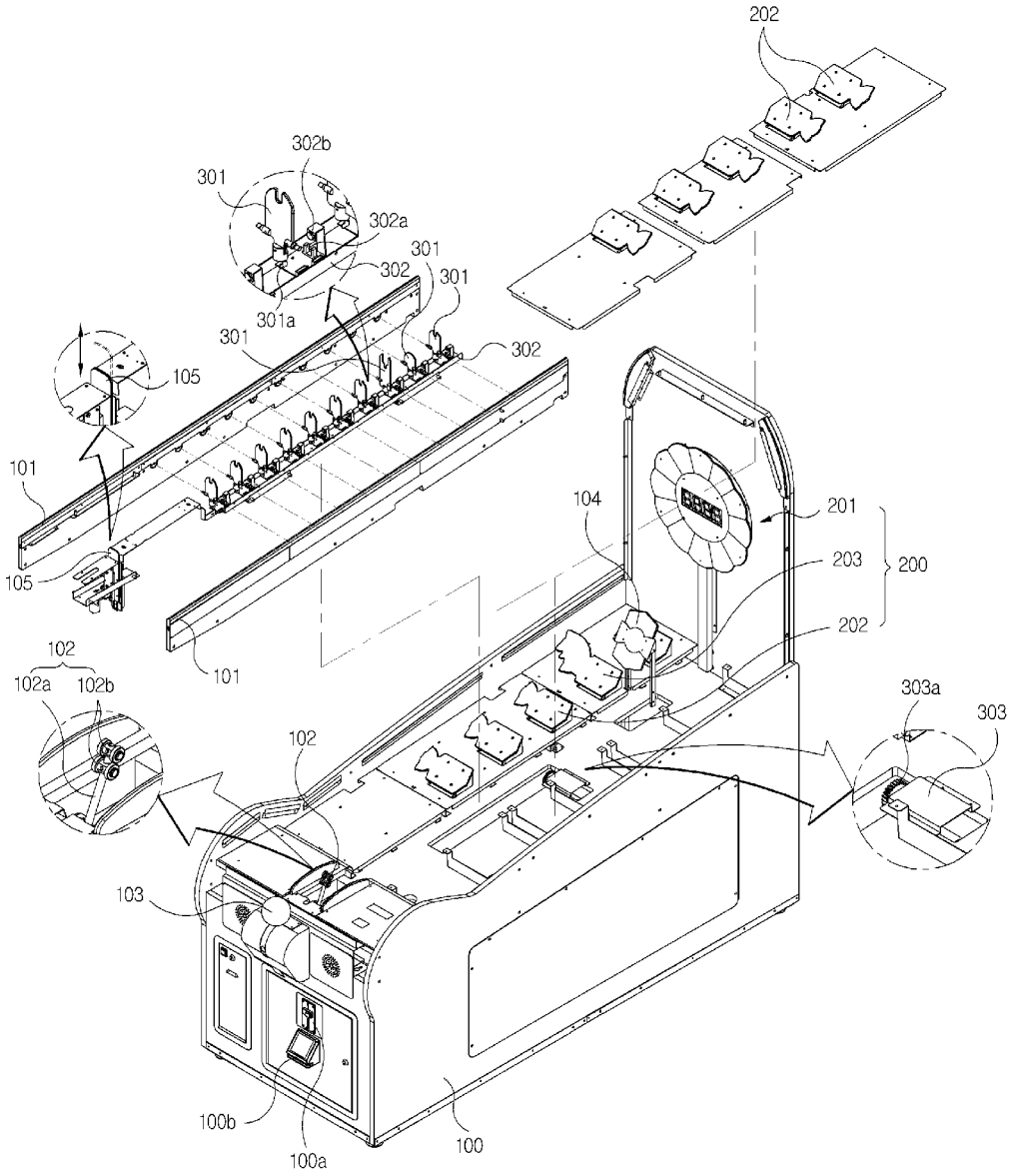
FIG. 2 is an exploded perspective view of FIG. 1.
Figure 3:
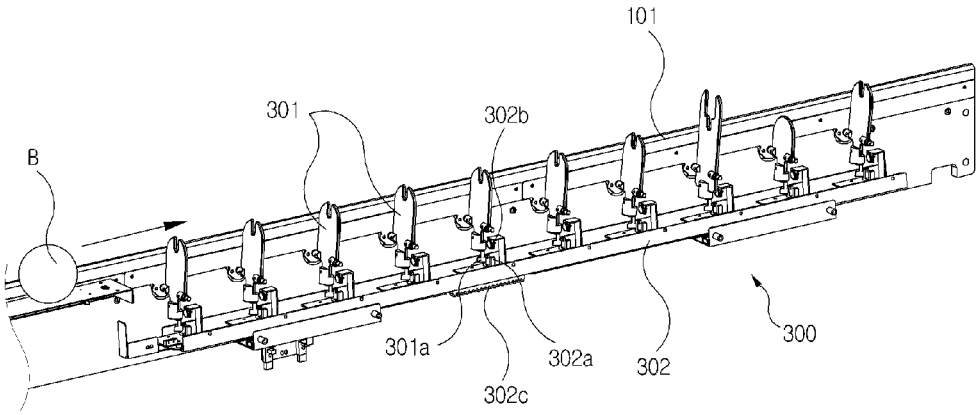
FIGS. 3 and 4 are perspective views illustrating a state in which a ball of the ticket outputting game machine according to the embodiment of the present invention moves while pushing a holding plate.
Figure 4:
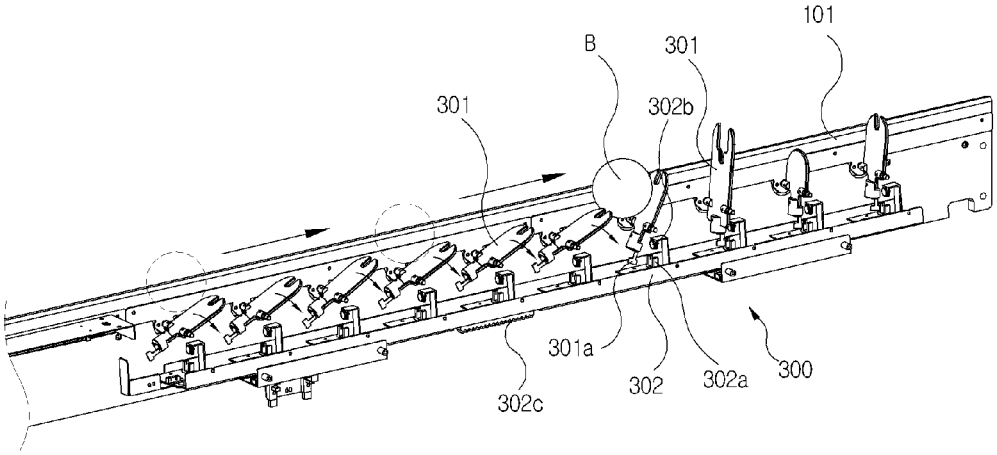
Figure 5:
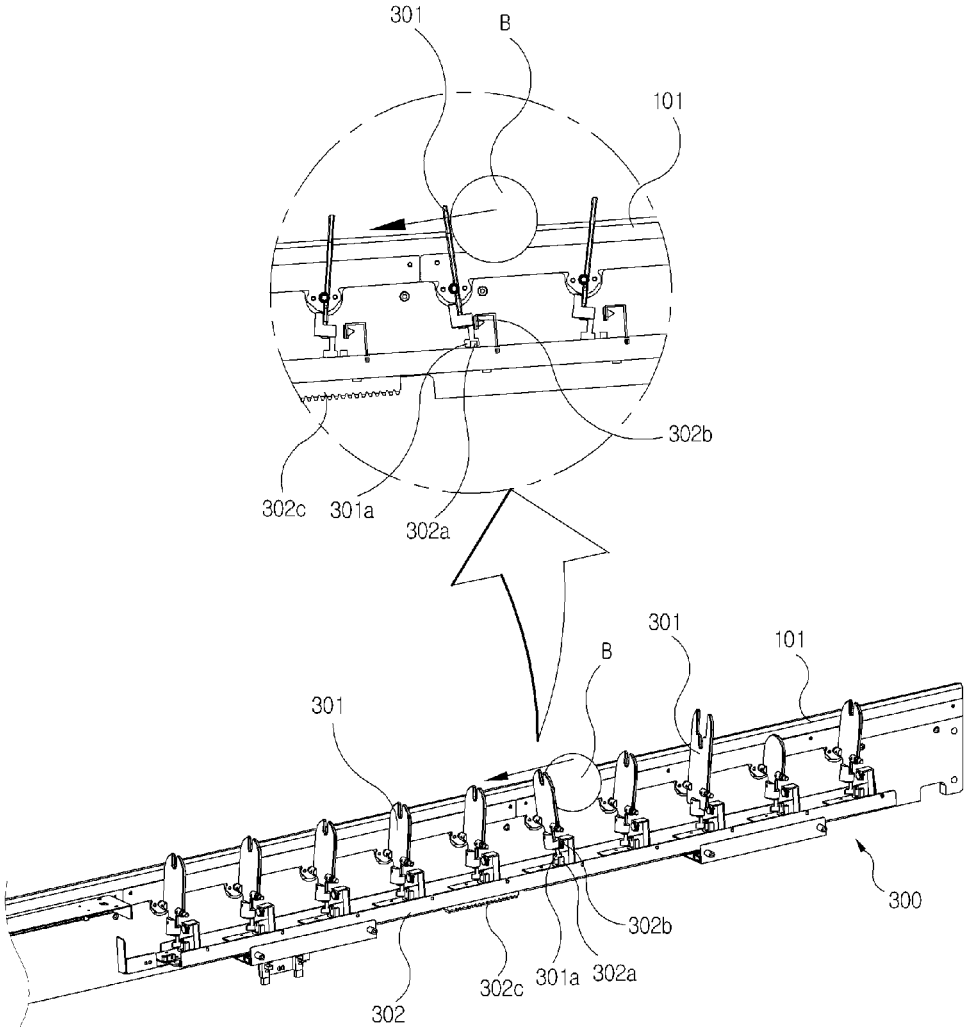
FIG. 5 is a perspective view illustrating a state in which the ball of the ticket outputting game machine according to the embodiment of the present invention is held by the holding plate.
Figure 6:
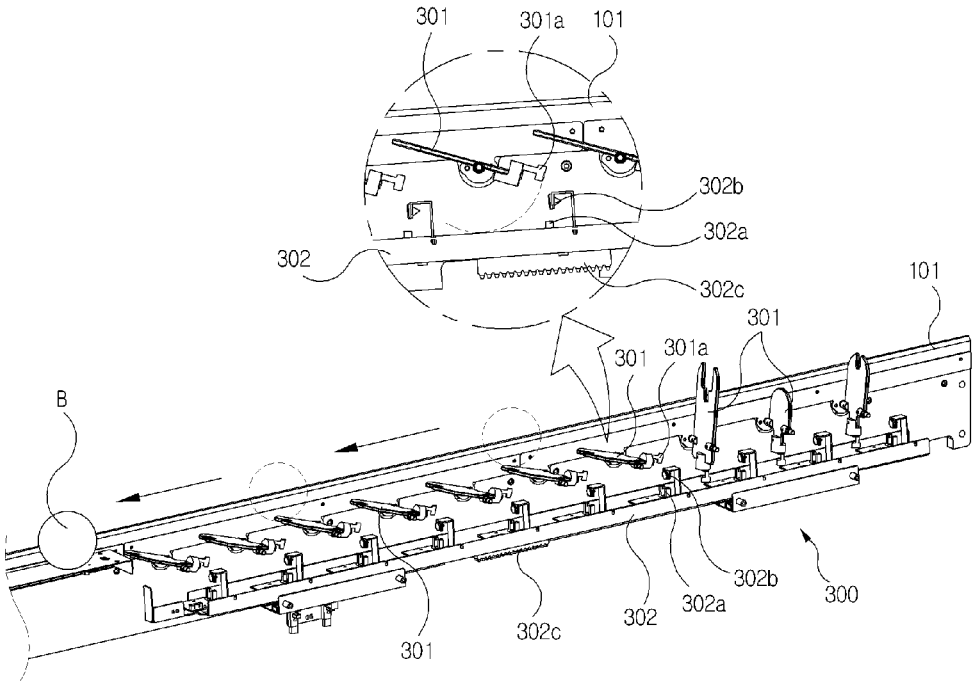
FIG. 6 is a perspective view illustrating a state in which the ball of the ticket outputting game machine according to the embodiment of the present invention, which is held by the holding plate, returns to an original position.

Hereinafter, embodiments of the present invention will be described in detail with reference to the attached drawings.

A body 100 includes a pair of guide rails 101 formed on a top surface thereof in a longitudinal direction, a hitting portion 102 formed at a front end of the guide rails 101 and configured to hit a ball B to allow the ball B to move along the guide rails 101, and a handle 103 formed on a front surface of the body 100 and connected to the hitting portion 102 to control a hitting force of the hitting portion 102.

The body 100 includes a coil inlet 100*a* and a ticket output portion 100*b* on the front surface thereof.

The top surface of the body 100 is inclined downward from a rear end toward a front end so as to induce the ball B to run down along the guide rails 101 in a free-fall manner.

The body 100 further includes a display panel 104 formed above the guide rails corresponding to an interconnected ticket display portion 203 of a ticket display device 200 and configured to allow the interconnected ticket display portion 203 to be identified.

The display panel 104 emits light to guide a player to see the interconnected ticket display portion 203 with the player's naked eyes.

The hitting portion 102 of the body 100 is pulled by the handle 103 to move backward but returns to an original position due to an elastic force and hits the ball B.

The hitting portion 102 rotates by a determined angle corresponding to the handle 103 and then hits the ball B while returning to an original position.

The hitting portion 102 includes a rotating bar 102*a*, which is rotated by a determined angle on the basis of one end, and a hitting roller 102*b* which is rotatably installed on a top end of the rotating bar 102*a* and rubs an external surface of the ball B together while hitting the ball B.

A pair of such hitting rollers 102*b* are symmetrically installed on top and bottom to be opposite to each other and rotated while rubbing the ball B.

A stopper 105, which prevents the ball B freely falling along the guide rails 101 of the body 100 from colliding with the hitting portion 102, is further formed at a front end of the hitting portion 102.

The stopper 105 is moved up to prevent the ball B from colliding with the hitting portion 102.

The guide rails 101 may include light emitting diodes (LED) mounted therein to emit light.

A plurality of such ticket display devices 200 are installed in a zigzag structure along a longitudinal direction of both sides of the guide rails 101 of the body 100 to display a ticket output amount.

The ticket display devices 200 are divided by a holding plate 301 of the ball position determination portion 300 installed between the guide rails 101.

The ticket display device 200 is formed at a position corresponding to a space between the holding plates 301 of the ball position determination portion 300.

The ticket display device 200 includes a bonus ticket display portion 201 installed at a rear end of the body 100 and configured to display a bonus ticket number, a plurality of fixed ticket display portions 202 installed along a longitudinal direction of both the guide rails 101 and configured to display a set output ticket number, and the interconnected ticket display portion 203 installed between the fixed ticket display portions 202 and configured to receive a signal of the bonus ticket display portion 201 and to display a bonus output ticket number.

The bonus ticket display portion 201 may display a relatively larger number of tickets than the number of tickets which is displayed on the fixed ticket display portion 202.

The bonus ticket display portion 201 may be set to display a set ticket number or a variable ticket number.

The bonus ticket display portion 201 may have an electronic display panel which displays the number of tickets or a big win zone structure which varies a number while continuously rotating in an annular shape.

The fixed ticket display portion 201 fixedly displays an output ticket number preset by a user.

The interconnected ticket display portion 203 interconnects with the bonus ticket display portion 202 and displays the set ticket number or the variable ticket number, which is displayed on the bonus ticket display portion 201.

The ball position determination portion 300 is installed between the guide rails 101 of the body 100 and passes the ball B moving along the guide rails 101 while allowing the ball B moving toward a front end of the body 100 to be held such that the ball B is located at a position corresponding to any one of the plurality of such ticket display portions 200.

The ball position determination portion 300 includes the holding plate 301, which is installed between the guide rails 101 to divide the plurality of ticket display devices 200 such that both ends thereof are rotatably installed on both ends of the guide rails 101 to rotate in position and includes a rotational bracket 301*a* protruding downward from a bottom end, a movement portion 302, which is installed below the holding plate 301 to be horizontally movable and includes a sensor 302*a* formed on a top surface thereof and sensing the rotational bracket 301*a* rotated by the holding plate 301, and a driving portion 303 which is installed below the movement portion 302 and horizontally moves the movement portion 302 to allow the sensor 302*a* to be located within a radius of the rotational bracket 301*a* or to deviate from the radius of the rotational bracket 301*a* so as to adjust a position of the movement portion 302.

The holding plate 301 is pushed and rotated by the ball B freely falling along the guide rails 101 and rotates the rotational bracket 301*a*.

The rotational bracket 301*a* is rotated by the holding plate 301 and sensed by the sensor 302*a*.

The ball position determination portion 300 includes, among the plurality of holding plates 301, a holding plate 301 which has a relatively long length and is formed at a front end between the guide rails 101 corresponding to the interconnected ticket display portion 203 of the ticket display device 200, and among the holding plates 301, a holding plate 301 which has a relatively short length and is formed at a rear end between the guide rails 101 corresponding to the interconnected ticket display portion 203 of the ticket display device 200.

The holding plate 301 which has a relatively longer length has a relatively wider rotational radius and delays a returning time for returning to an original position.

The holding plate 301 which has a relatively shorter length has a relatively smaller rotational radius and reduces a returning time for returning to an original position.

The sensor 302*a* of the movement portion 302 interconnects with each of the plurality of ticket display devices 200 and transfers a signal to the ticket output portion 100*b* of the body 100 such that the number of tickets corresponding to the ticket display device 200 is output through the ticket output portion 100*b*.

The sensor 302*a* of the movement portion 302 transfers the signal to the driving portion 303 to retract the movement portion 302 such that the sensor 302*a* of the movement portion 302 deviates from the rotational radius of the rotational bracket 301*a* of the holding plate 301.

The movement portion 302 further includes a buffer portion 302*b* formed at a top surface of one side of the sensor 302*a* and configured to restrict a rotation angle of the rotational bracket 301*a* of the holding plate 301.

The buffer portion 302*b* is rotated by the holding plate 301 and prevents the rotational bracket 301*a* sensed by the sensor 302*a* from deviating from the sensor 302*a*.

The buffer portion 302*b* includes a rubber material and buffers a collision of the rotational bracket 301*a*.

The movement portion 302 includes a rack gear 302*c* on a bottom surface.

The rack gear 302*c* is horizontally moved by a pinion gear 303*a* of the driving portion 303 and horizontally moves the movement portion 302.

The driving portion 303 receives any one of signals from a plurality of such sensors 302*a* and retracts the movement portion 302.

The driving portion 303 may return the movement portion 302 to an original position simultaneously while the stopper 105 is operated to move down and allows the ball B to deviate therefrom.

The driving portion 303 further includes the pinion gear 303*a* on one side thereof, which engages with the rack gear 302*c* and is driven to rotate so as to horizontally move the rack gear 302*c*.

The ticket outputting game machine having the above configuration according to one embodiment of the present invention is used as follows.

First, when a coin is inserted into the coin inlet 100*a* of the body 100, the stopper 105 of the body 100, which supports the ball B, is moved downward such that the ball B deviates from the stopper 105. At the same time, the ball B is moved along the inclined guide rails 101 and is pressed against the hitting portion 102.

Here, the hitting roller 102*b* of the hitting portion 102 rotates while rubbing the external surface of the ball B such that the ball B is supported by the hitting roller 102*b*.

Here, when the handle 103 is retracted while being gripped, the hitting portion 102 is pulled to correspond to the handle 103. Here, as the rotating bar 102*a* of the hitting portion 102 rotates in a direction corresponding to the handle 103, the hitting roller 102*b* rotates while supporting and rubbing the ball B.

Particularly, a pair of such hitting rollers 102*b* are formed to face each other and be vertically symmetrical to each other such that the pair of the hitting rollers 102*b* are pressed against and supported by external surfaces of both sides of the ball B based on a central part thereof.

Afterwards, when a pulling force of the handle 103 is released, the handle 103 and the hitting portion 102 return to original positions thereof due to an elastic force of the handle 103 and the hitting portion 102. Here, the ball B hit by the hitting roller 102*b* of the hitting portion 102 moves along the inclined guide rails 101.

Also, while moving along the guide rails 101 corresponding to the hitting force of the hitting portion 102, the ball B passes the holding plates 301 of the ball position determination portion 300, freely falls toward the front end of the body 100, and is held by any one of the plurality of holding plates 301 to be located in a space between the guide rails 101 corresponding to the ticket display device 200.

Here, the holding plate 301 is pushed and rotates in place by the ball B moving along the guide rails 101 to pass the ball B as it is and is pressed by the ball B freely falling along the guide rails 101 to rotate the rotational bracket 301*a* such that the rotational bracket 301*a* collides with the buffer portion 302*b* of the movement portion 302 and the rotation angle of the rotational bracket 301*a* is restricted.

Here, the sensor 302*a* of the movement portion 302 senses the rotational bracket 301*a* of the holding plate 301, which collides with the buffer portion 302*b* and is restricted in rotation and then transfers a signal thereof to the ticket output portion 100*b* so as to output a ticket through the ticket output portion 100*b*.

Particularly, since the sensor 302*a* of the movement portion 302 is connected to the fixed ticket display portion 202 and the interconnected ticket display portion 203 of the ticket display portion 200, tickets corresponding to an output ticket number displayed on the fixed ticket display portion 202 or the interconnected ticket display portion 203 are output through the ticket output portion 100*b*.

That is, when the ball B is held by the holding plate 301 of the ball position determination portion 300 to be located between the guide rails 101 corresponding to the fixed ticket display portion 202, the sensor 302*a* of the movement portion 302 outputs the output ticket number displayed on the fixed ticket display portion 202 to the ticket output portion 100*b* such that tickets corresponding to the fixed ticket display portion 202 are output through the ticket output portion 100*b*.

On the other hand, when the ball B is held by the holding plate 301 of the ball position determination portion 300 to be located between the guide rails 101 corresponding to the interconnected ticket display portion 203, the sensor 302*a* of the movement portion 302 outputs the output ticket number displayed on the bonus ticket display portion 201 to the ticket output portion 100*b* such that tickets corresponding to the bonus ticket display portion 201 are output through the ticket output portion 100*b*.

Here, the number of tickets displayed on the bonus ticket display portion 201 may be a fixed ticket number set by the user or may be set to be variable.

Particularly, when the number of tickets displayed on the bonus ticket display portion 201 is set to be variable, the number of tickets displayed on the bonus ticket display portion 201 may be increased by a determined range or the bonus ticket display portion 201 may be formed as a big-win-zone structure in which a number varies during continuous annular rotation.

Also, the sensor 302*a* transmits a sensed signal to the driving portion 303 to horizontally move the driving portion 303 such that the sensor 302*a* and the buffer portion 302*b* of the movement portion 302 deviate from the rotational radius of the rotational bracket 301*a* of the holding plate 301. Accordingly, the buffer portion 302*b*, which restricts the rotation angle of the rotational bracket 301*a*, deviates such that the holding plate 301 rotates in place and induces the ball B to freely fall along the guide rails 101.

Here, the pinion gear 303*a* of the driving portion 303 is coupled to be engaged with the rack gear 302*c* of the movement portion 302, receives a signal of the sensor 302*a*, and drives the pinion gear 303*a* to rotate such that the rack gear 302*c* is horizontally moved by the pinion gear 303*a* and horizontally moves the movement portion 302.

Afterwards, the ball B freely falls along the guide rails 101 and is supported by the stopper 105. Sequentially, the stopper 105 is moved upward to place the ball B at the hitting portion 102 simultaneously while the pinion gear 303*a* of the driving portion 303 horizontally moves the rack gear 302*c* and returns the movement portion 302 to an original position.

Here, the stopper 105 may be moved upward to cover a front of the hitting portion 102 right after the ball B moves along the guide rails 101 due to the hitting portion 102 or as soon as the ball B is held by the holding plate 301.

Meanwhile, among the holding plates 301 of the ball position determination portion 300, the holding plate 301 having a relatively long length is formed at a front end between the guide rails 101 corresponding to the interconnected ticket display portion 203 and the holding plate 301 having a relatively short length is formed at a rear end therebetween.

That is, the holding plate 301 having a relatively long length has a relatively wider rotational radius and delays a returning time. Also, the holding plate 301 having a relatively short length has a relatively smaller rotational radius and reduces a returning time.

Accordingly, when the ball B moves along the guide rails 101 and arrives at a space between the guide rails 101 corresponding to the interconnected ticket display portion 203, a level of difficulty in a game is changed by inducing the ball B to be held by the holding plate 301 which reduces the returning time due to the relatively short length thereof or to pass the holding plate 301 which delays the returning time due to the relatively long length thereof.

Further, a game is continuously played by repeating the above operations.

In the above-described structure in which the ball B is hit by the hitting portion 102 to be held at a determined position on the guide rails 101 by the ball position determination portion 300 while the number of tickets displayed on the ticket display device 200 corresponding to the position of the ball B held at the determined position on the guide rails 101 are output through the body 100, a game can be easily played by determining a hitting force of the hitting portion 102, which hits the ball B, using a pulling force of pulling the handle 103 regardless of a difference in physiques of players. Also, all players who play the game can play the game under the same conditions and obtain fair result values. Since the ball B can be hit by an action of simply pulling the handle 103, it is possible to play the game for a long time and children, the old and the infirm, or women, whose muscular strength is weak, can play the game together such that the number of participants in the game increases.

According to embodiments of the present invention, since a hitting force of a hitting portion, which hits a ball, is determined by a pulling force of pulling a handle regardless of physique of a player, a game can be easily played and all players can play the game under the same conditions and obtain fair results. Also, since the ball can be hit by a simple action of pulling the handle, it is possible to play the game for a long time and children, the old and the infirm, and women, whose muscular strength is weak, can also play the game such that the number of game players increases. Here, the ball is located at a ticket display device designated by a user according to the user's manipulatory ability to obtain a different number of tickets such that competitiveness among players is promoted simultaneously while a sense of accomplishment increases.

The above-described ticket outputting game machine according to the present invention is not limited to the above embodiment, and the technical concept thereof includes a range of various modifications by any one of ordinary skill in the art without departing from the scope of the present invention defined by the following claims.

What is claimed is:

1. A ticket outputting game machine comprising:

a body which comprises a pair of guide rails formed on a top surface thereof along a longitudinal direction, a hitting portion formed at a front end of the guide rails to hit a ball to allow the ball to move along the guide rails, and a handle formed on a front surface thereof and connected to the hitting portion to control a hitting force of the hitting portion;

a plurality of ticket display devices installed in a zigzag structure along a longitudinal direction of both sides of the guide rails to display a ticket output amount; and a ball position determination portion installed between the guide rails of the body and configured to pass the ball moving along the guide rails to allow the ball moving toward a front end of the body to be held such that the ball is located at a position corresponding to any one of the plurality of ticket display devices.

2. The ticket outputting game machine of claim 1, wherein the hitting portion of the body is pulled by the handle to move backward but returns to an original position due to an elastic force and hits the ball.

3. The ticket outputting game machine of claim 1, wherein the hitting portion comprises:

a rotating bar which is rotated by a determined angle on the basis of one end; and a hitting roller which is rotatably installed on a top end of the rotating bar and rubs an external surface of the ball to hit the ball.

4. The ticket outputting game machine of claim 1, wherein the ticket display device comprises:

a bonus ticket display portion installed at a rear end of the body and configured to display a bonus ticket number;

a plurality of fixed ticket display portions installed along a longitudinal direction of both the guide rails and configured to display a set output ticket number; and an interconnected ticket display portion installed between the fixed ticket display portions and configured to receive a signal of the bonus ticket display portion and display a bonus output ticket number.

5. The ticket outputting game machine of claim 1, wherein the ball position determination portion comprises:

a holding plate which is installed between the guide rails to divide the plurality of ticket display devices while both ends thereof are rotatably installed on both ends of the guide rails to rotate in position and which comprises a rotational bracket protruding downward from a bottom end of the holding plate;

a movement portion which is installed below the holding plate to be horizontally movable and comprises a sensor formed on a top surface of the holding plates and configured to sense a rotational bracket rotated by the holding plate; and a driving portion which is installed below the movement portion and horizontally moves the movement portion to allow the sensor to be located within a radius of the rotational bracket or to deviate from the radius of the rotational bracket so as to adjust a position of the movement portion.

6. The ticket outputting game machine of claim 5, wherein the ball position determination portion comprises:

among the plurality of holding plates, a holding plate which has a relatively long length and is formed at a front end between the guide rails corresponding to the interconnected ticket display portion of the ticket display device; and among the holding plates, a holding plate which has a relatively short length and is formed at a rear end between the guide rails corresponding to the interconnected ticket display portion of the ticket display device.

7. The ticket outputting game machine of claim 5, wherein the movement portion further comprises a buffer portion formed at a top surface of one side of the sensor and configured to restrict a rotation angle of the rotational bracket of the holding plate.

8. The ticket outputting game machine of claim 5, wherein the movement portion comprises a rack gear on a bottom surface thereof, and wherein the driving portion further comprises a pinion gear on one side thereof, which engages with the rack gear and is rotatably driven to horizontally move the rack gear.

* * * * *